US007089602B2

(12) United States Patent
Talluri

(10) Patent No.: US 7,089,602 B2
(45) Date of Patent: Aug. 15, 2006

(54) MULTI-LAYERED, IMPACT ABSORBING, MODULAR HELMET

(76) Inventor: Srikrishna Talluri, 23730 Pond Rd., #121, Southfield, MI (US) 48034

( * ) Notice: Subject to any disclaimer, the term of this patent is extended or adjusted under 35 U.S.C. 154(b) by 0 days.

(21) Appl. No.: 10/881,068

(22) Filed: Jun. 30, 2004

(65) Prior Publication Data

US 2004/0261157 A1 Dec. 30, 2004

Related U.S. Application Data

(60) Provisional application No. 60/483,858, filed on Jun. 30, 2003.

(51) Int. Cl.
*A42B 1/22* (2006.01)

(52) U.S. Cl. ..... 2/411; 2/412; 2/413; 2/422; 267/114

(58) Field of Classification Search ..... 2/411, 2/412, 413, 414, 425, 422, DIG. 3
See application file for complete search history.

(56) References Cited

U.S. PATENT DOCUMENTS

| | | | | |
|---|---|---|---|---|
| 2,296,335 | A * | 9/1942 | Brady | 2/412 |
| 2,381,524 | A * | 8/1945 | Taylor | 2/7 |
| 3,174,155 | A * | 3/1965 | Pitman | 2/411 |
| 3,242,500 | A * | 3/1966 | Derr | 2/412 |
| 3,447,163 | A * | 6/1969 | Tojeiro et al. | 2/412 |
| 3,787,893 | A * | 1/1974 | Larcher | 2/413 |
| 3,872,511 | A * | 3/1975 | Nichols | 2/413 |
| 3,999,220 | A * | 12/1976 | Keltner | 2/413 |
| 4,124,904 | A * | 11/1978 | Matthes | 2/413 |
| 4,937,888 | A * | 7/1990 | Straus | 2/411 |
| 5,083,320 | A * | 1/1992 | Halstead | 2/413 |
| 5,181,279 | A * | 1/1993 | Ross | 2/413 |
| 5,713,082 | A * | 2/1998 | Bassette et al. | 2/412 |
| 5,946,734 | A * | 9/1999 | Vogan | 2/412 |
| 5,956,777 | A * | 9/1999 | Popovich | 2/424 |
| 6,317,895 | B1 | 11/2001 | Erth et al. | |
| 6,363,539 | B1 * | 4/2002 | Tachi et al. | 2/412 |
| 6,425,141 | B1 | 7/2002 | Ewing et al. | |
| 6,446,270 | B1 | 9/2002 | Durr | |
| 6,467,099 | B1 | 10/2002 | Dennis et al. | |
| 2004/0261157 | A1 * | 12/2004 | Talluri | 2/412 |

FOREIGN PATENT DOCUMENTS

| | | | |
|---|---|---|---|
| DE | 3530396 | A1 * | 2/1987 |
| DE | 3619282 | A1 * | 12/1987 |
| FR | 2566632 | A1 * | 1/1986 |
| WO | WO 9614768 | A1 * | 5/1996 |

* cited by examiner

*Primary Examiner*—Rodney M. Lindsey

(57) ABSTRACT

An impact absorbing, modular helmet that prevents or reduces injury to the user and other parties in a collision is described. The helmet has layers on the outer side of the hard casing that increase the time of impact and thereby reduces the intensity of the impact forces to reduce their injury potential. The layers may be made up of uniformly consistent impact absorbing polymer material, a polymer layer filled with air or a polymer honeycombed structure. These impact-absorbing layers may also be made and used as an independent, detachable, external protective cover that may be attached universally over hard casing helmets.

8 Claims, 7 Drawing Sheets

MULTI-LAYERED, IMPACT ABSORBING, MODULAR HELMET

CROSS-REFERENCE TO RELATED APPLICATIONS

This application claims the benefit of priority of U.S. Provisional Patent Application Ser. No. 60/483,858, filed Jun. 30, 2003 and entitled "MULTI-LAYERED, IMPACT ABSORBING, MODULAR HELMET", the subject matter of which is hereby incorporated by reference herein.

BACKGROUND OF THE INVENTION

This invention relates generally to protective headgear and, more specifically, to an impact absorbing, modular helmet that reduces damage to the user and other parties in a collision.

Protective headgear or helmets are worn by individuals to protect against head injuries. The use of helmets is often a mandatory requirement for driving bicycles and certain other motor vehicles, in high impact sports and in material handling areas and other potentially hazardous conditions.

While the use of safety helmets has been just that—to reduce or completely protect the user from any top, lateral and penetration impact to the user's head, recent events have shown that in high impact sports such as football, there has been an increasing use of the helmet as an initial contact point while tackling and blocking. Helmets are now often being used as a weapon (unintentionally or otherwise), to cause physical harm to opponents.

Commonly used protective headgear uses a hard outer casing with an impact-energy absorbing padding placed between the outer casing and the user's head. These hard casing helmets have several disadvantages. Such hard casing helmets actually permit the generation of a high-impact shock wave and then try to minimize its effects by the use of shock absorbing material. In sports such as baseball or cricket, where the helmet's primary purpose is to protect the head from the impact of a high velocity ball, the generation of such a high-impact shockwave (when a ball strikes the hard outer casing of the helmet) often results in the sudden movement of the head and neck in the direction of the ball and if the impact is high enough, it may lead to a concussion (striking of the brain matter to the skull with moderate force) or even a contusion (striking of the brain matter to the skull with high force) and may also lead to skull fracture.

Published research suggests that the human skull can fracture at decelerations as low as 225 G's and that concussions can occur at substantially lower decelerations. Research has shown that to offer maximum protection to the head, the rate of deceleration should be as low as possible.

Further, when such hard casing helmets are used by young school children while playing football, even though the impact force is low, considerable damage can happen, for instance, if a child's palm is caught between two helmets—at the time of collision.

Hence, it is the object of the present invention to overcome the abovementioned problems and create a novel and improved versatile, durable protective helmet

BRIEF SUMMARY OF THE INVENTION

Accordingly, it is an object of the present invention to provide a helmet that reduces the shockwave generation at the first instance itself.

It is another object of the present invention to provide a multi-layered helmet that prevents damage by lowering the rate of deceleration of the user's head.

It is yet another object of the present invention to provide a multi-layered helmet with at least one impact-energy absorbing outer casing.

It is still yet another object of the present invention to provide a protective high impact-energy absorbing layer that can be used universally over hard casing helmets.

It is still yet another object of the present invention to provide a high impact-energy absorbing layer that is collapsible yet resilient.

It is still yet another object of the present invention to provide a protective helmet that can be manufactured economically.

DETAILED DESCRIPTION OF THE INVENTION

The present invention incorporates plural high impact-energy absorbing outer layers secured to the rigid shell of a protective helmet. The helmet further has at least one energy absorbent material between the hard casing and the user's head.

Figure 1:
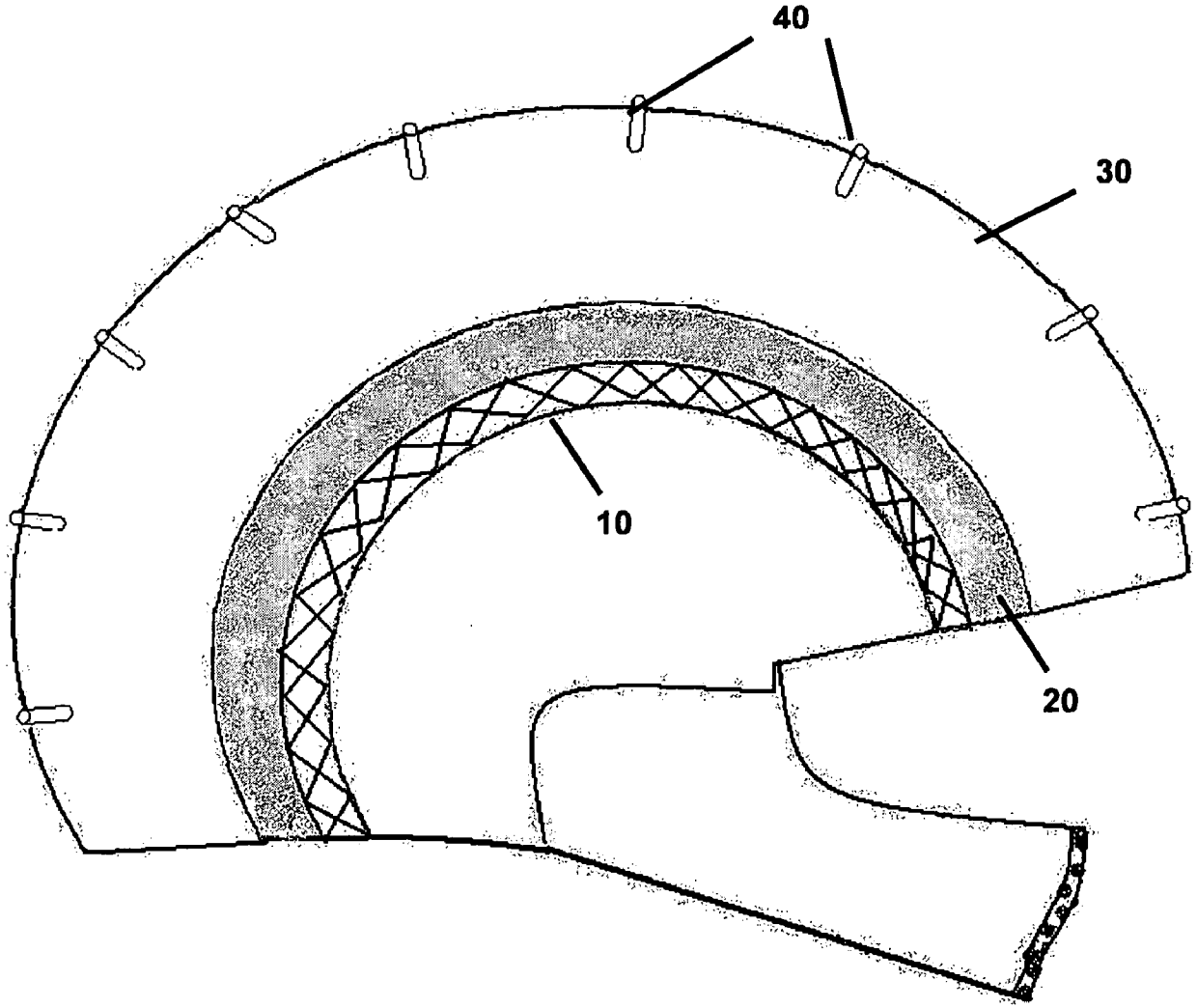
FIG. 1 depicts a cross-sectional view of a helmet with two protective impact-absorbing layers on the outer side of the hard casing one of them being an air chambered layer and the other made of uniformly consistent polymeric material.

The preferred embodiment of the present invention (FIG. 1) consists of two layers over the hard casing 10. The outermost layer 30 consists of an air chamber ensconced within a highly durable polymeric material with one or more air pressure release valves 40. This entire outer layer may be made up of a single air chamber or several, small multiple ones with each such chamber having its own air release valve(s). The purpose of the valves is to release the air and permit the gradual collapse of the chamber, when the pressure inside increases beyond a certain threshold, while maintaining the structural integrity of the layer. Multiple valves are designed for an air chamber—as air may be released through alternate valves if one or more valves are directly covered and are involved in the impact area.

This outer layer is firmly attached to the next energy-absorbing layer 20, which is made up of another energy absorbent, uniformly consistent material such as flexible polyurethane foam, which is in turn attached to the hard casing 10 of the protective helmet.

The following examples illustrate the benefits of such a multi-layered protective helmet.

When a high velocity ball strikes the protective helmet as described in the preferred embodiment, the first protective layer increases the impact time (duration of impact) by subjecting itself to deformation. When the pressure on the air within the chamber rises beyond a certain level, the air release valve(s) permit the collapse of the chamber by releasing the air within the same. The ball then comes in contact with the next layer such as the elastic polyurethane foam layer, which further absorbs the impact energy and reduces the generated shockwave and simultaneously lowers the deceleration rate of the user's head.

In the case of a collision between the user of the protective helmet and an opposing player in football, the absorbing layers increase the time of impact, which reduces the impact force that in turn reduces the potential damage to the opposing player. The same benefits apply in the case of a young child whose hand may get caught between two such multi-layered helmets (in a school football match) or when a bicycle rider using such a helmet has an impact between the helmet and the ground.

The helmet also enables easy reconstruction. Even though the air chamber may have collapsed, merely refilling with air restores the outer layer—as long as the durable polymer material is structurally stable. Even if the polymer material is damaged, this outer layer can be easily detached and replaced with a new one.

In a modification of the preferred embodiment, the outer layer(s) may be manufactured as an integrated, standalone protective layer that could be universally adapted and incorporated onto any existing helmet to transfer the benefits described above.

In another embodiment of the present invention, in line with the usage of plural energy absorbing layers on the outer side of the hard casing of a helmet, a honeycomb structured with hollow spaces for air is used as described below.

Figure 2:
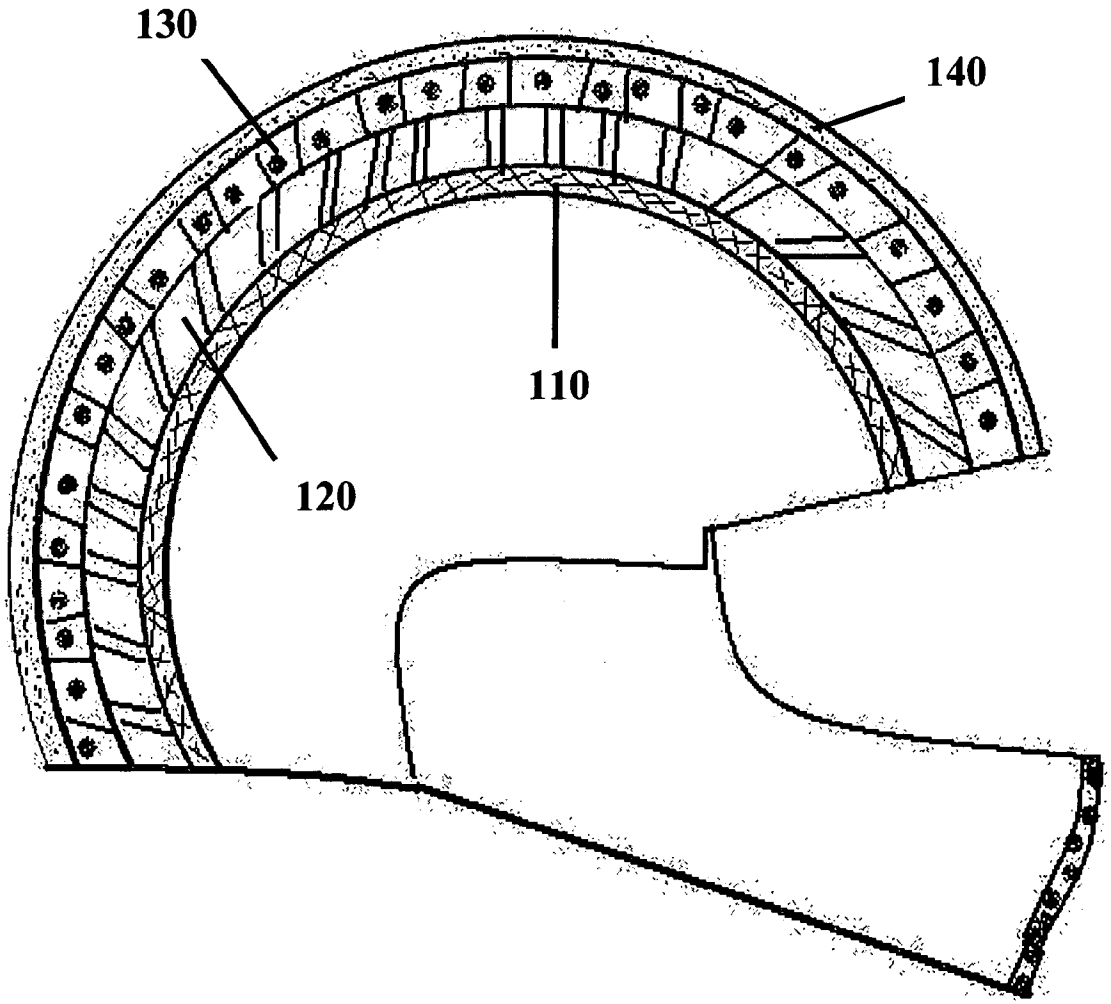
FIG. 2 depicts a cross-sectional view of a helmet with three protective impact-absorbing layers on the outer side of the hard casing one of them being a honeycombed polymeric layer.
Figure 3A:
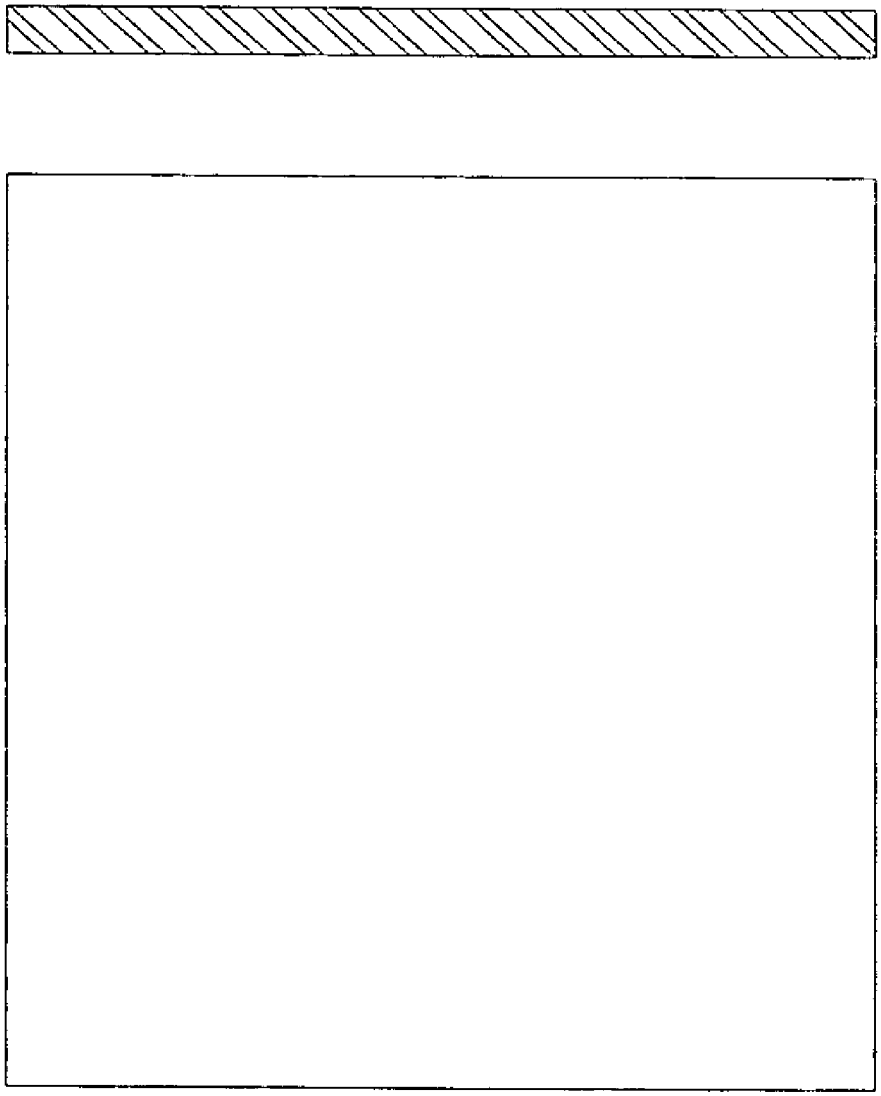
FIGS. 3A, 3B and 3C independently show the top view (plan) and side view of each of the three impact-absorbing layers of FIG. 2.
Figure 3B:
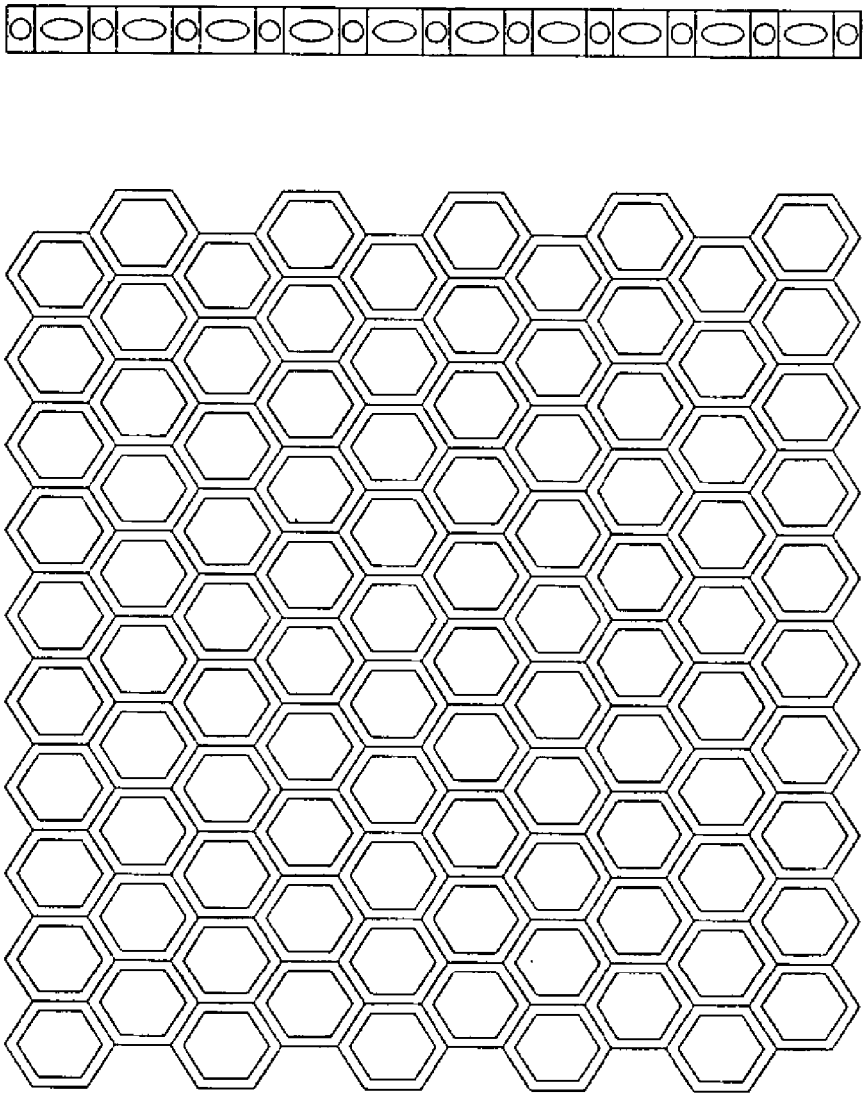
Figure 3C:
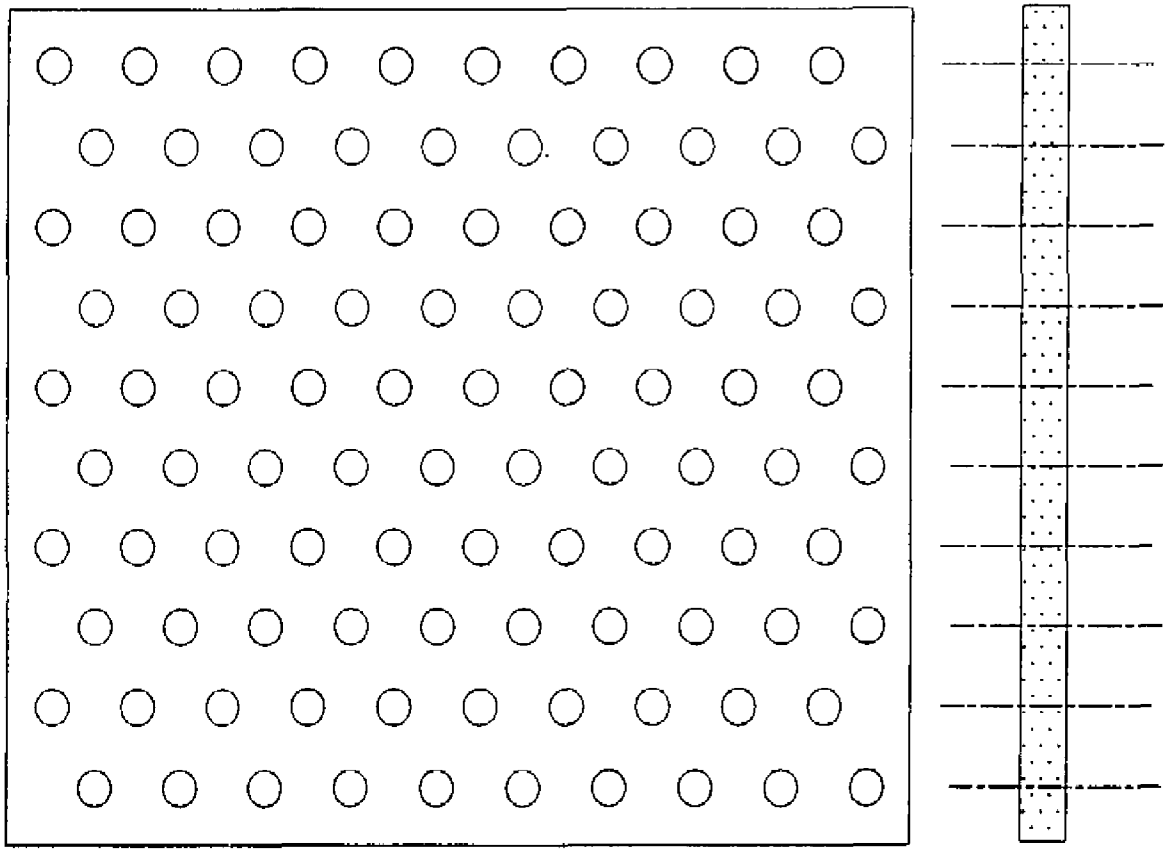
Figure 4:
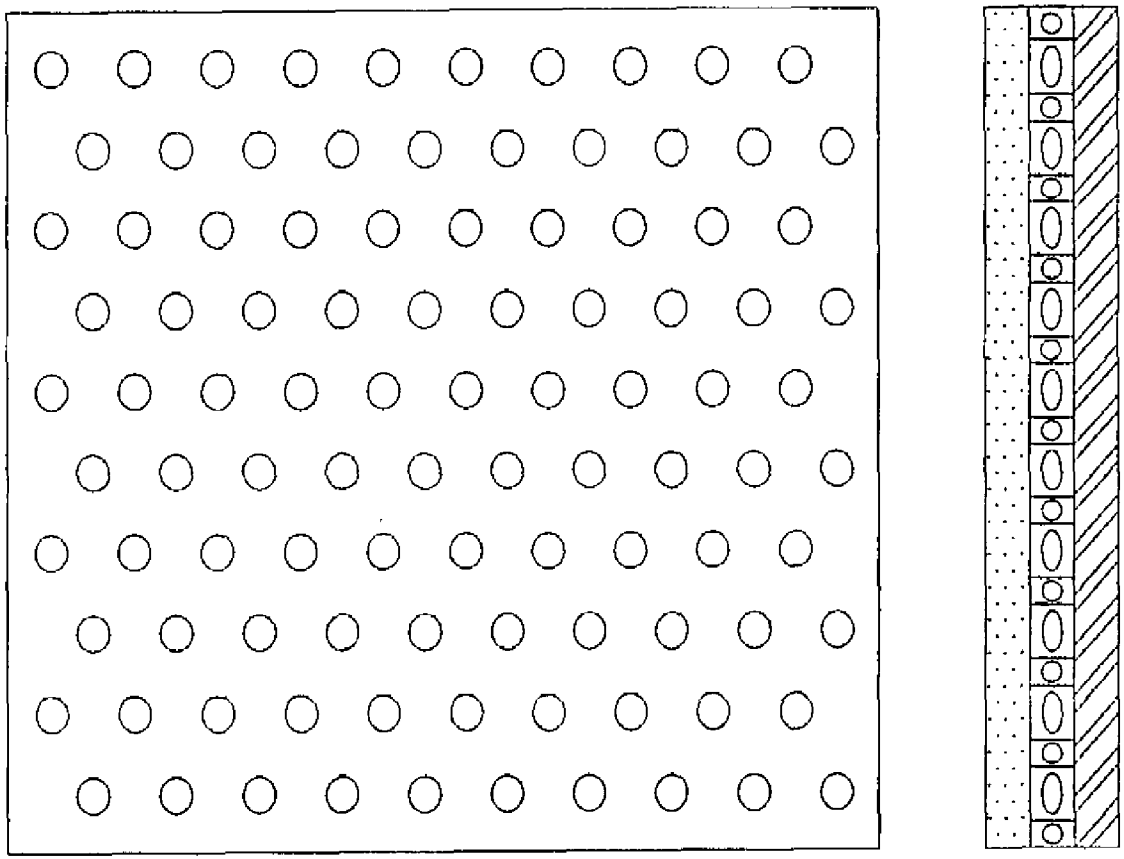
FIG. 4 shows the top view (plan) and side view of the three layers of FIG. 2, as they would be used in practice.

This embodiment of the present invention shown in FIG. 2 (cross sectional view of the helmet) consists of three layers over the hard casing 110. The layer attached to the hard casing of the helmet is 120, an energy absorbent, uniformly consistent material such as flexible polyurethane foam corresponding to layer 20 in FIG. 1. The next layer 130 on the outer side of 120 is a honeycombed structure with hollow hexagonal cells. It should be noted that the walls of these hexagonal cells are perforated with oval or circular shaped holes so that when a particular hexagonal cell is compressed by an external impact, the air in this cell may pass through the holes in the walls to adjacent cells. The outermost layer 140 in this embodiment is a flexible, polymer one with holes in it, which each hole corresponding to a single hollow, hexagonal cell of the honeycombed layer beneath it. The top view (plan) and side view of layers 120, 130 and 140 are shown independently in FIGS. 3A, 3B and 3C respectively. FIG. 4 shows a combination of these three layers in the sequence they would be attached onto the hard casing of a helmet as described in this embodiment. The side view of FIG. 4 distinctly shows the three layers that would be used over the hard casing of the helmet.

The diameter of the holes in layer 140 of FIG. 2, however, would be much smaller when compared to that of the hexagonal cells in layer 130—the purpose of which is now explained. When a ball strikes the helmet described in this embodiment or when the helmets of two players in contact sports such as football hit each other (with at least one of the helmets being the one described in this embodiment), the impact is evenly resisted by the honeycombed layer 130 with the hexagonal cells bearing the impact gradually getting compressed by letting out the air within them through the holes in the walls of the hexagonal cells into adjacent cells and thereon out of the helmet through the holes in the outermost layer 140. By using holes with a smaller diameter in layer 140, the time taken for the air from within layer 130 to escape into the environment takes a little bit longer—thereby resisting the impact force by further increasing the time of impact and reducing the shockwave that would otherwise be created by these impact forces. If the impact force is higher than that can be handled by layer 130, the impact is then transferred to the inner layer 120, which being another energy absorbing layer further increases the time of impact and further reduces the force of the impact.

When the impact force is no longer in effect, such as when the ball that strikes the helmet has bounced off or when the helmets of the football players are no longer in contact, the elastic nature of the walls of the hexagonal cells of the honeycombed layer 130 comes into play and the walls regain their original shape. During this process of the compressed walls (of the hexagonal cells that bore the impact) regaining their original shape, air is automatically sucked in from the environment through the corresponding holes in layer 140 and also from adjacent cells through the holes in the walls. To maintain equilibrium, the adjacent cells while giving out the air contained in their cells (to the ones regaining their original shape) in turn suck in air from the environment through the hole that is just above their cell in layer 140. Similarly, the elastic nature of the innermost layer 120 makes the layer retain its original shape.

The outermost layer 140 may be an independent one not firmly attached with the rest of the layers and may be detached from the rest of the helmet when necessary. In this embodiment, the layer 140 may consist of an attachment strip, such as the commercially available Velcro, on the inner side of its edges, which would correspond to an attaching Velcro strip on the edges of the helmet. This layer would then be held in its proper place by virtue of the corresponding attachment strips. The reason for such independency being that if the usage of the helmet is under rainfall, this outer layer 140 may be removed whenever necessary and the water droplets that may have seeped in through the holes into the empty spaces of the hexagonal cells in layer 130 may then be got rid/drained off by merely turning the helmet upside down. The layer 140 may then be easily put back in its proper place on the helmet by pressing down on the attachment strip.

Figure 5:
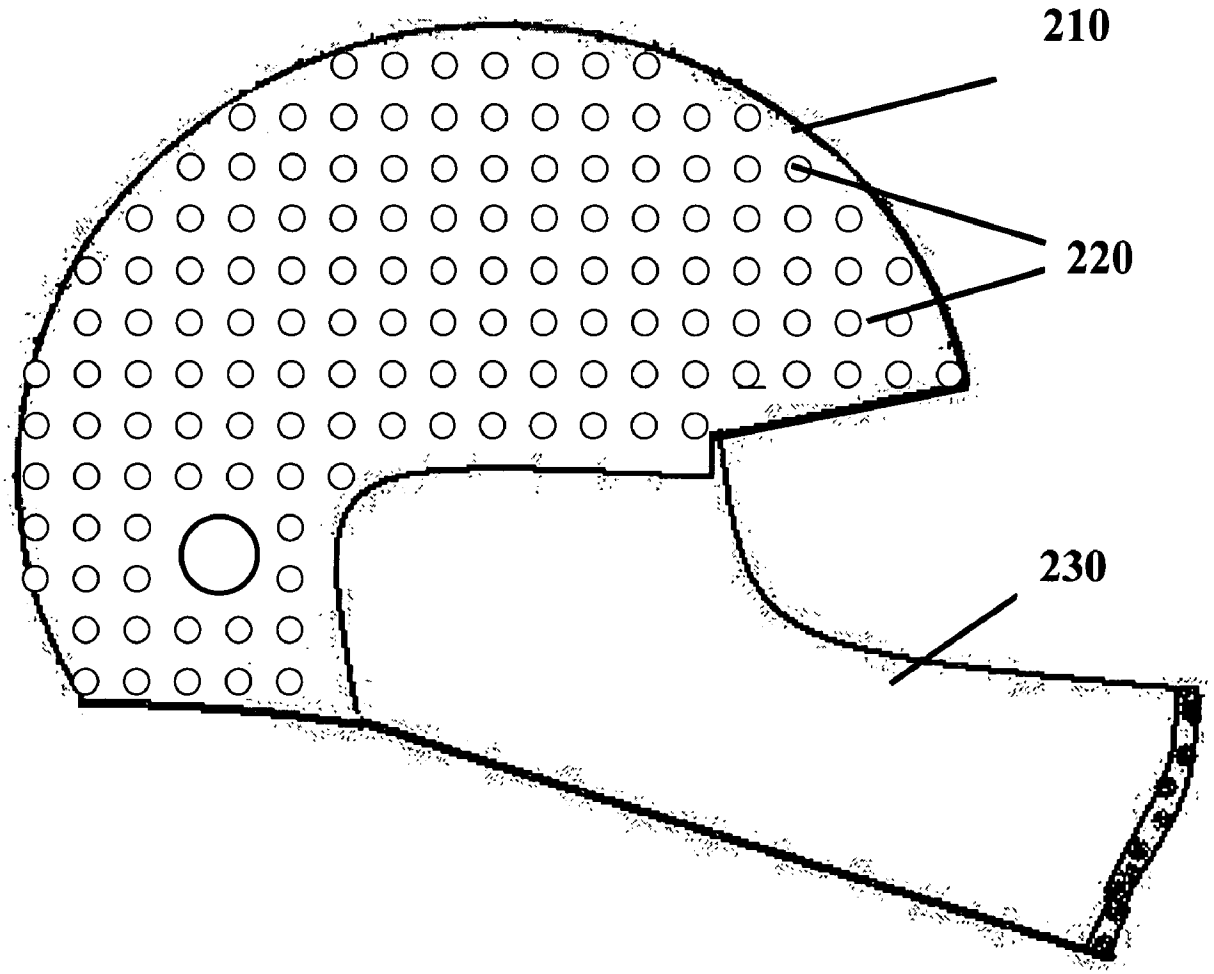
FIG. 5 depicts the outer appearance of a helmet whose cross-sectional view was shown in FIG. 2.

The appearance of the helmet described in this embodiment is shown in FIG. 5, where 210 represents the outer layer corresponding to layer 140 in FIG. 2. 220 represent the holes in the outer layer and 230 represents the visor (not related to the invention).

In another embodiment of the present invention, in line with the usage of plural energy absorbing layers on the outer side of the hard casing of a helmet, a polymer layer filled with air is placed between the hard casing of a helmet and another outer protective, energy/impact absorbing layer made of uniformly consistent material such as flexible polyurethane foam. In yet another slightly modified version of this embodiment, the air filled layer may be placed between two other layers made of uniformly consistent material such as flexible polyurethane foam. The air filled layer would have no air release valves or any other mechanism to release the air. This layer would merely deform to gradually increase the time of impact to reduce the intensity of the impact force and regain its original shape and form when the source of the impact force is no longer in contact with the outer layer of the helmet.

In a modification of these embodiments, the outer layer(s) may be manufactured as an integrated, standalone protective cover that could be universally adapted and incorporated onto any existing helmet to pass on the benefits of using the same.

In the foregoing specification, the invention has been described with reference to an illustrative embodiment thereof. However, it will be evident that various modifications and changes may be made thereto without departing from the broader spirit and scope of the invention. The specification and drawings are, accordingly, to be regarded in an illustrative rather than a restrictive sense. Therefore, it is the object of the appended claims to cover all such modifications and changes as come within the true spirit and scope of the invention.

What is claimed is:

1. A protective headgear assembly that reduces the impact forces by spreading them laterally and uses air to resist the impact forces and decrease the rate of deceleration of the human head, said headgear assembly comprising of:

an energy absorbent layer made of uniformly consistent viscoelastic material in contact with and placed directly on the outside of a rigid shell;

a honeycomb layer with hollow cells and perforated walls for air to flow from one cell to another, in contact with and placed over the viscoelastic energy absorbent layer;

a cover over such honeycomb layer, made of soft yet resilient material with small perforations that match with the hollow cells, said perforations being smaller than the hollow cell under it, to provide a constricted passage for the trapped air in the hollow cells to escape into the atmosphere upon impact.

2. A protective headgear assembly of claim 1, where the energy absorbent, viscoelastic layer is made of polyurethane.

3. A protective headgear of claim 1, where the layers are modular and each layer can be removed and replaced independent of the other layers.

4. A protective headgear assembly of claim 1, where the three layers are manufactured as an independent external assembly that may be used universally over the rigid shell of helmets.

5. A protective headgear assembly that reduces the impact forces by spreading them laterally and uses air to resist the impact forces and decrease the rate of deceleration of the human head, said headgear assembly comprising of:

a honeycomb layer with hollow cells and perforated walls for air to flow from one cell to another, in contact with and placed directly on the outside of a rigid shell; and a cover over such honeycomb layer, made of soft yet resilient material with small perforations that match with the hollow cells, said perforations being smaller than the hollow cell under it, to provide a constricted passage for the trapped air in the hollow cells to escape into the atmosphere upon impact.

6. A protective headgear assembly of claim 5, where the two layers are manufactured as an independent external assembly that may be used universally over the rigid shell of helmets.

7. A protective headgear assembly that reduces the impact forces by spreading them laterally and uses air to resist the impact forces and decrease the rate of deceleration of the human head, said headgear assembly comprising of:

a honeycomb layer with hollow cells and perforated walls for air to flow from one cell to another, in contact with and placed directly on the outside of a rigid shell; and an energy absorbent layer made of uniformly consistent viscoelastic material in contact with and placed directly on the outside of such a honeycomb layer.

8. A protective headgear assembly of claim 7, where the two layers are manufactured as an independent external assembly that may be used universally over the rigid shell of helmets.

* * * * *